US005689851A

United States Patent [19]

de Sevren Jacquet

[11] Patent Number: 5,689,851

[45] Date of Patent: Nov. 25, 1997

[54] UNITARY HANDLE-HANGER

[76] Inventor: Norman H. de Sevren Jacquet, 20538 Barnard Ave., Walnut, Calif. 91789

[21] Appl. No.: 736,397

[22] Filed: Oct. 24, 1996

[51] Int. Cl.[6] ..... A46B 15/00

[52] U.S. Cl. ..... 15/159.1; 15/143.1; 15/246; 248/213.2; 248/682; D4/132

[58] Field of Search ..... 15/143.1, 159.1, 15/246; 248/110, 213.2, 682, 686, 690, 692; D4/132, 135, 138

[56] References Cited

U.S. PATENT DOCUMENTS

| | | | |
|---|---|---|---|
| 334,993 | 1/1886 | Smith | 248/692 X |
| D. 365,210 | 12/1995 | Bell et al. | D4/132 |
| 1,289,171 | 12/1918 | Hilton . | |
| 1,313,515 | 8/1919 | Caffrey . | |
| 1,328,162 | 1/1920 | Hecht . | |
| 1,713,077 | 5/1929 | Frizl . | |
| 1,925,053 | 8/1933 | Massino | 248/110 X |
| 2,309,990 | 2/1943 | Savi | 248/110 X |
| 3,231,919 | 2/1966 | MacDonald . | |
| 3,961,729 | 6/1976 | Grimm | 15/246 X |
| 4,589,159 | 5/1986 | Streibel | 15/143.1 X |
| 4,627,125 | 12/1986 | Gruns | 15/143.1 X |
| 5,044,038 | 9/1991 | Matkovic | 15/159.1 |
| 5,087,014 | 2/1992 | Desjardin | 248/110 X |
| 5,406,668 | 4/1995 | Goodhue | 15/159.1 |

FOREIGN PATENT DOCUMENTS

| | | | |
|---|---|---|---|
| 1149791 | 12/1957 | France | 15/143.1 |
| 1330704 | 5/1963 | France | 15/143.1 |
| 2676629 | 11/1992 | France | 15/143.1 |
| 1059879 | 6/1959 | Germany | 15/246 |
| 500424 | 2/1939 | United Kingdom | 15/143.1 |

*Primary Examiner*—Mark Spisich

[57] ABSTRACT

A handle with unitary handle-hanger having a built-in recess which suspends a paintbrush when placed on the inner sealing flange of a paint can. The handle can be made from wood, plastic, or other suitable material.

18 Claims, 3 Drawing Sheets

UNITARY HANDLE-HANGER

BACKGROUND OF THE INVENTION

This invention relates to a handle with a built-in hanger to suspend a tool.

BACKGROUND—DESCRIPTION OF PRIOR ART

Numerous paint applicator hangers have been provided in prior art. For example, U.S. Pat. No. 5,406,668 Goodhue; U.S. Pat. No. 1,289,171 to Hilton; U.S. Pat. No. 1,313,515 to Caffrey; 1,328,162 to Hecht; U.S. Pat. 1,713,007 to Frizl; U.S. Pat. No. 3,231,919 to MacDonald; and U.S. Pat. No. 5,044,038 to Matkovic all are illustrative of such prior art. These would not be suitable for the purposes of my built-in hanger as heretofore described.

SUMMARY OF THE INVENTION

Previous inventors have created several types of paintbrush hangers. All of these have moveable parts such as a hook or pivotal arm. These are not practical because the moveable part can become rusted or paint can get onto the moveable part and hamper the operation of the hanger. All of the paintbrush hangers heretofore known suffer from a number of disadvantages:

(a) The hook or pivotal arm could become damaged.

(b) The hook or pivotal arm could get caught in clothing or injure a person using the brush with said hanger.

(c) Their manufacture requires complex manufacturing techniques.

Accordingly, a primary object of the unitary handle-hanger of this invention is to provide a paintbrush hanger that will overcome the shortcomings of the prior art devices. My unitary handle-hanger has no moveable parts and is therefore capable of repeated use without restriction in operation. Other objects and advantages of my unitary handle-hanger are:

(a) to provide a built-in hanger which cannot be damaged.

(b) to provide a built-in hanger which cannot cause damage to property or injury to people.

(c) to provide a built-in hanger which is economical in cost to manufacture.

Further objects and advantages are to provide a handle with built-in hanger so that the handle can be normally gripped by a hand of a person using the paintbrush, so that the paintbrush can be supported on a paint can to elevate the bristles of the paintbrush within the paint can, and to provide a handle with built-in hanger that is simple and easy to use, easy to manufacture, environmentally sound when using recyclable plastic as material of choice. Still further objects and advantages will become apparent from a consideration of the ensuing description and drawings.

DESCRIPTION OF THE PREFERRED EMBODIMENTS

Figure 1:
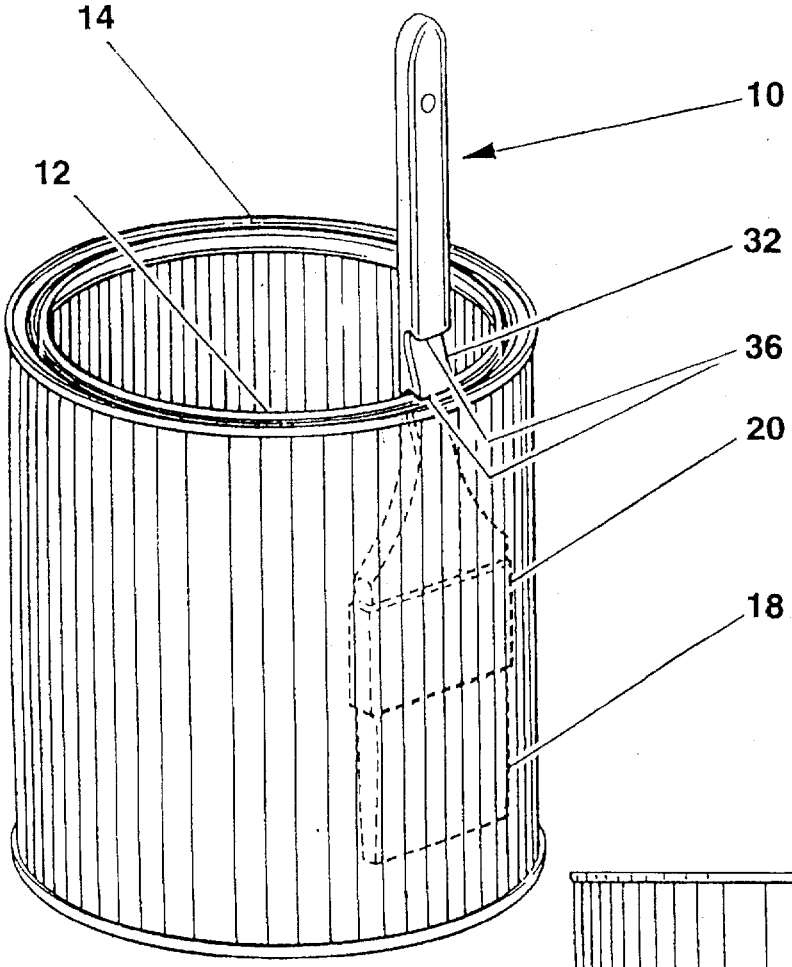
FIG. 1 shows a front perspective of the instant invention suspended on a inner sealing flange of a paint can.
Figure 2:
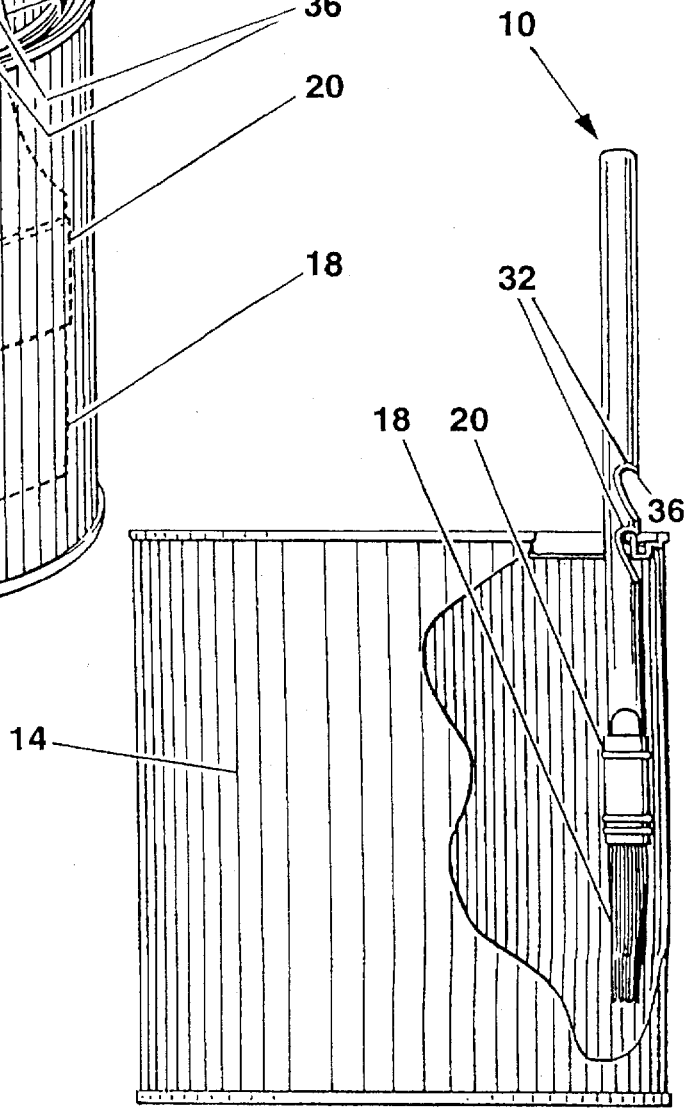
FIG. 2 shows a side view of FIG. 1 with the paint can broken out.
Figure 3:
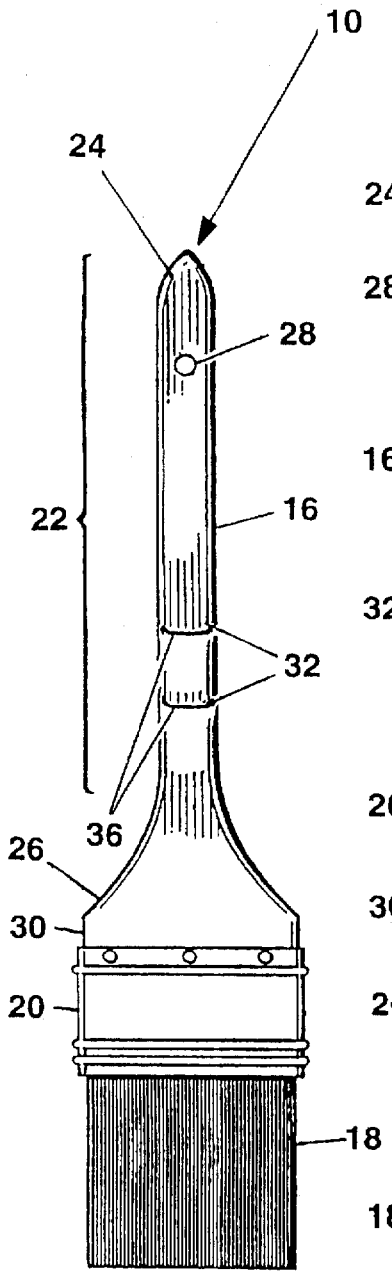
FIG. 3 shows a front view of the instant invention.
Figure 4:
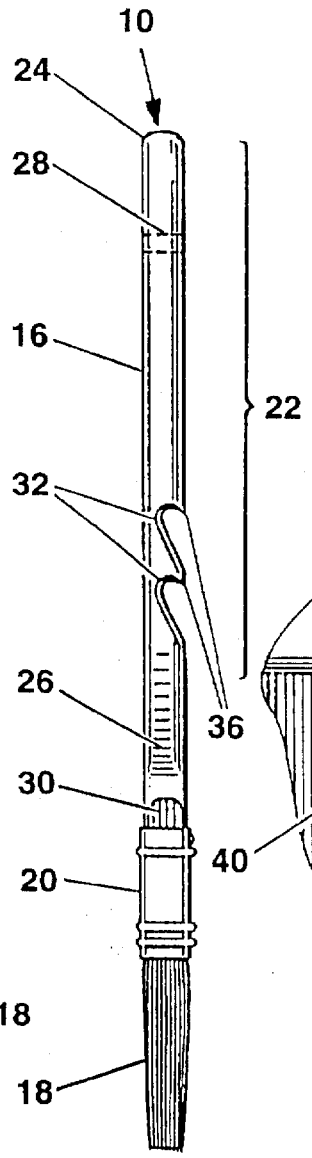
FIG. 4 shows a side view of the instant invention.

A typical use of the unitary handle-hanger of this invention is shown in FIGS. 1 and 2 wherein the unitary handle-hanger is utilized in paintbrush 10 shown to be hanging from inner sealing flange 12 of paint can 14.

In particular, with reference to FIGS. 1 to 5, a paintbrush 10 having unitary handle-hanger 16, bristles 18, and ferrule 20 is used to illustrate this invention. Unitary handle-hanger 16 has the customary elongated upper portion 22 with free end 24 and opposing heel portion 26. Near free end 24 a hole 28 can be provided for hanging the brush when in a store display. Ferrule 20 attaches bristles 18 to the wider lower portion of heel 30 in a conventional manner.

It can be seen that the unitary handle-hanger 16 of this invention has recess or recesses 32 which are an integral part of the elongated upper portion 22 of unitary handle-hanger 16. Although recess or recesses 32 are shown in elongated upper portion 22 of the handle, it is to be understood, however, that such recess or recesses can also be in the heel portion 26 of the handle if desired (not shown in the figures), to prevent heel portion 26 from being in paint when paint can 14 is nearly full.

Figure 5:
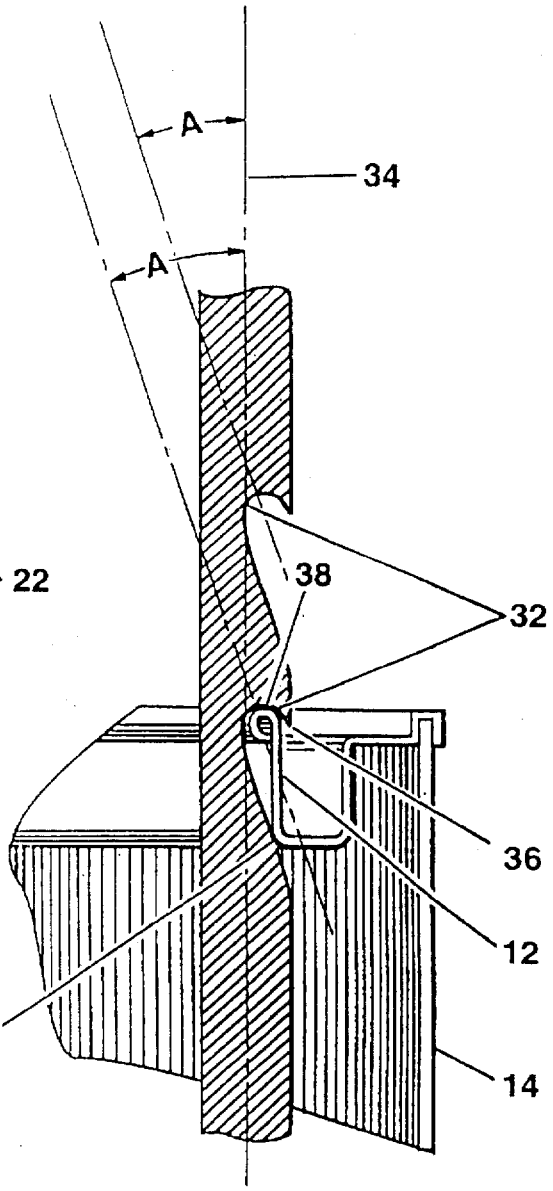
FIG. 5 shows an enlarged cross-sectional view of the handle showing the built-in hangers or recess therein in greater detail.
Figure 6:
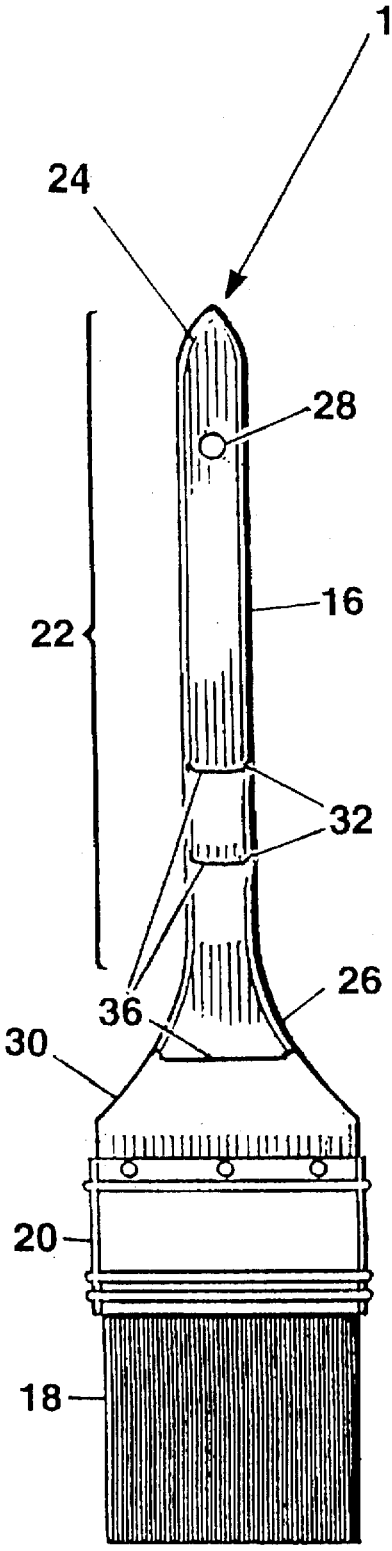
FIG. 6 shows a front view of another embodiment of the invention.
Figure 7:
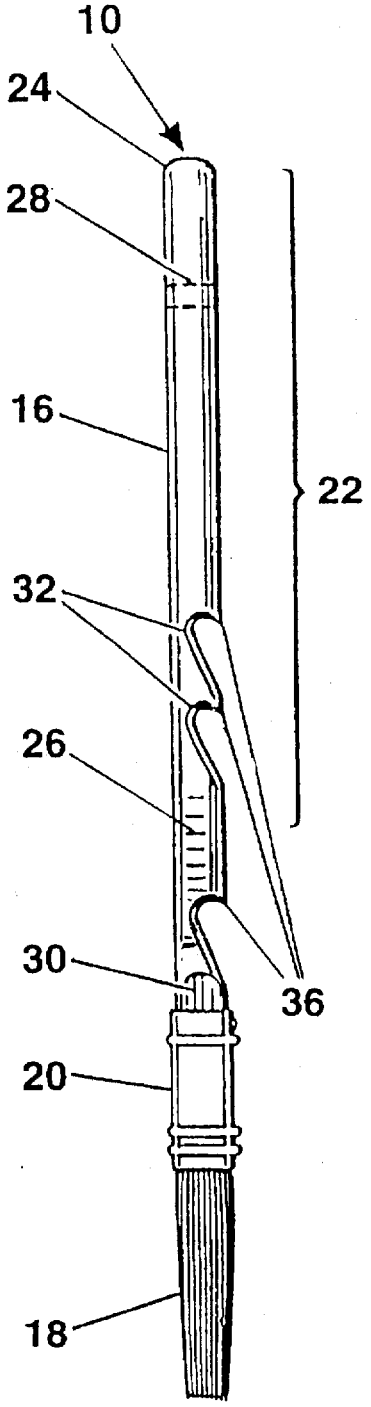
FIG. 7 shows a side view of the embodiment of FIG. 6.

As shown in FIG. 5, each recess 32 extends upward at an angle A of about 20 degrees from the axis 34 of the handle thereby forming a downwardly extending lip 36 which hooks at point 38 of the recess onto inner sealing flange 12 of paint can 14 with a second point of contact of the recess at point 40 thereby stabilizing the paintbrush in its hanging position so that it does not swing freely as the paint can is moved thereby tending to prevent the paintbrush from falling into the paint. Other angles of the recess or recesses can be used, of course, if desired. In one embodiment, the recess extends upward at an angle A of between about 10 degrees and about 45 degrees from axis 34. In another embodiment, the recess extends upward at an angle A of between about 15 degrees and about 35 degrees from axis 34.

The unitary handle-hanger supports the brush in the paint can so that the bristles are elevated within the paint can. One of the recesses hooks onto the inner sealing flange of the paint can. The handle can consist of any hard material such as wood or plastic. In one embodiment, the unitary handle-hanger is made from a material selected from the group consisting of wood, plastic, pressed particle board, paper board, and mixtures thereof.

There are various possibilities with regard to the relative positioning of the unitary handle-hanger as reflected in FIG. 5. From the description above, other advantages of my unitary handle-hanger become evident. When using a paintbrush, the paintbrush can be hung from the inner sealing flange of a paint can, thereby keeping bristles wet and suspended in their natural form within the paint can. Other applications include using the built-in recess in the poles of tools such as brooms and mops or gardening tools to hang them for storage.

The manner of using the unitary handle-hanger is to place the handle perpendicular to the side of the paint can and place the recess onto the inner sealing flange. Accordingly, the reader will see that the unitary handle-hanger can be used easily and conveniently.

The unitary handle-hanger permits production of the handle in a variety of materials, it provides a hanger with no moveable parts, without impairing the function of the tool, and it can be used to hang a variety of tools.

Although the description above contains many specificities, these should not be construed as limiting the scope of the invention but as merely providing illustrations of some of the presently preferred embodiments of my invention. For example, the unitary handle-hanger can embody other shapes, such as triangular, rounded, etc. Thus, the scope of the invention should be determined by the appended claims and their legal equivalents, rather than by the examples given.

What is claimed is:

1. A paint brush adapted to be supported on an inner sealing flange of a paint can, said brush comprising:

(a) a brush body including an elongated handle having opposite first and second ends and an enlarged heel portion located at one of said ends, said heel portion including a plurality of bristles projecting therefrom, the brush having a front and a back side coinciding with the length of said enlarged heel portion;

(b) at least two recesses integrally formed in said body on one of said sides and located at spaced locations therealong, each of said recesses comprising a substantially flat portion extending toward said bristles and oriented at an acute angle with respect to the longitudinal axis of the handle, each of said recesses further having an upper portion thereof formed with a lip adjacent a substantially concave surface which extends downwardly in the general direction of the bristles; and (c) said recesses permitting the paint brush to be selectively supported at different distances with respect to a bottom of the paint can, each of the recesses further being configured so that they are adapted to contact the inner sealing flange at two points coinciding with an upper and a lower portion of the inner sealing flange.

2. The paint brush of claim 1, wherein the recesses are at an angle between about 10 degrees and about 45 degrees to the longitudinal axis of the handle.

3. The paint brush of claim 1, wherein the recesses are at an angle between about 15 degrees and about 35 degrees to the longitudinal axis of the handle.

4. The paint brush of claim 1, wherein the handle with the enlarged heel portion is made from a single unitary piece of material.

5. The paint brush of claim 1, wherein each of the recesses has a recess width, and wherein the traverse width of at least one recess is longer than that of another recess.

6. The paint brush of claim 1, wherein the handle has a shape that can be gripped by one hand of a person using the paint brush.

7. The paint brush of claim 1, wherein the paint brush has no moveable parts necessary for being supported on the inner sealing flange.

8. A paint brush adapted to be supported on an inner sealing flange of a paint can, said paint brush comprising:

(a) a brush body including an elongated handle having opposite first and second ends and an enlarged heel portion located at one of said ends, said heel portion including a plurality of bristles projecting therefrom, the paint brush having a front side, a back side, a right side, and a left side, the front and back sides coinciding with the length or broader sides of said enlarged heel portion;

(b) a recess integrally formed in and across said body on one of said front and back sides, the recess comprising a substantially flat portion extending toward said bristles and oriented at an acute angle with respect to the longitudinal axis of the handle, said recess further having an upper portion thereof formed with a lip adjacent a substantially concave surface which extends downwardly in the general direction of the bristles; and (c) said recess permitting the paint brush to be supported at a distance with respect to a bottom of the paint can, the recess further being configured so that it is adapted to contact the inner sealing flange at two points coinciding with an upper and a lower portion of the inner sealing flange.

9. The paint brush of claim 8, wherein the recess is at an angle between about 10 degrees and about 45 degrees to the longitudinal axis of the handle.

10. The paint brush of claim 8, wherein the handle with the enlarged heel portion is made from a single unitary piece of material.

11. The paint brush of claim 8, wherein the paint brush has no movable parts necessary for being supported on the inner sealing flange.

12. A brush adapted to be supported on a flange, said brush comprising:

(a) a brush body including an elongated handle having opposite first and second ends and an enlarged heel portion located at one of said ends, said heel portion including a plurality of bristles projecting therefrom, the brush having a front and a back side coinciding with the length of said enlarged heel portion;

(b) at least two recesses integrally formed in said body on one of said sides and located at spaced locations therealong, each of said recesses comprising a substantially flat portion extending toward said bristles and oriented at an acute angle with respect to the longitudinal axis of the handle, each of said recesses further having an upper portion thereof formed with a lip adjacent a substantially concave surface which extends downwardly in the general direction of the bristles; and (c) said recesses permitting the brush to be selectively supported at different positions with respect to the flange, each of the recesses further being configured so that they are adapted to contact the flange at two points coinciding with an upper and a lower portion of the flange.

13. The brush of claim 12, wherein the recesses are at an angle between about 10 degrees and about 45 degrees to the longitudinal axis of the handle.

14. The brush of claim 12, wherein the recesses are at an angle between about 15 degrees and about 35 degrees to the longitudinal axis of the handle.

15. The brush of claim 12, wherein the handle with the enlarged heel portion is made from a single unitary piece of material.

16. The brush of claim 12, wherein each of the recesses has a recess width, and wherein the traverse width of at least one recess is longer than that of another recess.

17. The brush of claim 12, wherein the handle has a shape that can be gripped by one hand of a person using the brush.

18. The brush of claim 12, wherein the brush has no movable parts necessary for being supported on the flange.

* * * * *